United States Patent [19]

Pinto et al.

[11] Patent Number: 4,785,506

[45] Date of Patent: Nov. 22, 1988

[54] APPARATUS FOR OPENING PRESSED FIBER BALES OF SPINNING MATERIAL

[75] Inventors: Akiva Pinto, Gastonia, N.C.; Gunter LucaBen, Haltern; Reinhard Schmidt, Gescher, both of Fed. Rep. of Germany

[73] Assignee: Hergeth Hollingsworth GmbH, Duelmen, Fed. Rep. of Germany

[21] Appl. No.: 63,337

[22] Filed: Jun. 16, 1987

[30] Foreign Application Priority Data

Jun. 18, 1986 [DE] Fed. Rep. of Germany ..... 3620312

[51] Int. Cl.[4] ..... D01G 7/04

[52] U.S. Cl. ..... 19/80 R; 19/81

[58] Field of Search ..... 19/80 R, 81

[56] References Cited

U.S. PATENT DOCUMENTS

| | | | |
|---|---|---|---|
| 3,101,513 | 8/1963 | Wildbolz | 19/80 R |
| 3,170,196 | 2/1965 | Denis | 19/80 R |
| 4,623,099 | 11/1986 | Vosbein | 19/80 R |
| 4,662,031 | 5/1987 | Feiks et al. | 19/80 R |
| 4,707,888 | 11/1987 | Binder et al. | 19/81 X |

FOREIGN PATENT DOCUMENTS

| | | | |
|---|---|---|---|
| 1131567 | 6/1962 | Fed. Rep. of Germany . | |
| 2917122 | 10/1980 | Fed. Rep. of Germany | 19/80 R |
| 2353478 | 10/1982 | Fed. Rep. of Germany . | |
| 2100766 | 1/1983 | United Kingdom | 19/80 R |

*Primary Examiner*—Louis K. Rimrodt

*Attorney, Agent, or Firm*—Cort Flint

[57] ABSTRACT

An apparatus for opening pressed bales of textile fiber comprising spaced grid rods which are adapted to press against the surface of the bale. A toothed disk is mounted on a shaft which extends transversely of the grid rods and is supported to rotate in the space between the grid rods. The toothed disk has a plurality of teeth extending at an angle from the plane in which its central portion lies so that the tips of adjacent teeth revolve in the space between the grid rods in a different orbital path. The paths of the several teeth are adapted to be evenly spaced within the space between the grid rods.

15 Claims, 2 Drawing Sheets

APPARATUS FOR OPENING PRESSED FIBER BALES OF SPINNING MATERIAL

BACKGROUND OF THE INVENTION

The invention relates to an apparatus for opening pressed fiber bales of spinning material, e.g. cotton, synthetic fibers or the like, by means of a milling roller whose toothed disks act on the bale surface through a grid formed of bars. The outwardly directed teeth of the toothed disk are directed oppositely to the adjacent tooth extending in outward direction.

In an opening means of the above mentioned type, known from German Patent No. 23 52 478, the teeth of the opening disk are individual projections arranged symmetrically to its longitudinal axis. The side edge of the free end of each tooth as an angular, preferably a pointed angular design, and it is possible for each tooth to be directed outwardly in the opposite direction to the adjacent tooth. The teeth of such an opening disk used for milling are effective in each direction of rotation of the disk and in each direction of movement of the fiber bale. The opening disks are arranged in pairs between two grid rods. The opening disks are set relatively close together, side by side, within a space determined by the grid bars. Further, the height of the teeth of the disk is rather short.

German Patent No. 11 31 567 discloses a bale rasp for opening pressed fiber bales in which the saw toothed disks are provided between the grid rods and are tumbling, i.e. they are arranged at an angle different from ninety degrees relative to the axis of rotation. By this means, it is intended that due to their oblique position, the disks tumble to and fro between two extreme positions thus sweeping over nearly the total space between the grid rods. The bales are reduced in the total zone situated between the grid rods. The teeth of the rasp disks are situated in the slope of the tumbling plate. A teeth setting is not realized this way. Further, the height of the teeth is extremely short so that the fiber material is mainly reduced by a rasping operation rather than by milling.

The known opening means do not maximize and optimize the careful reduction of fibers from pressed bales, but the fibers are torn out of the bale as flocks of lesser or larger size, whereby, due to damaged fibers, the amount of short fibers is increased.

SUMMARY OF THE INVENTION

It is an object of the invention to provide an opening apparatus for pressed fiber bales in which it is possible, together with a most careful fiber treatment, to open fiber bales in a relatively easy, uniform and smooth manner. The invention is characterized by the provision of a milling disk fitted with teeth of a different setting. At the same time, within the space between a pair of grid rods, the projections of the milling disk teeth are set differently so as to be distributed over the grid space confined by two grid rods as seen in front view.

Due to such a configuration of the opening apparatus, a relatively easy opening is achieved while the fibers are treated very carefully. The processing is performed over the space between the grids. The size of removed flock may be kept small to a large extent.

Longer fibers are not damaged. Moreover, less power is required and the production output is generally higher. Fiber removal is more reliably intensified.

The setting of the teeth on one side of the disk plane may vary from that of other teeth directed to the other side of the disk plane. In this case, in the resultant milling disk the angle of the setting on the one side is smaller than that of the other side. The disk plane is no longer situated centrally between the outermost teeth tips.

According to another feature of the invention, the milling disk may be provided with six teeth. Two of them are situated in the disk plane and two teeth, each provided diametrically, are set to extend alternatingly to the one and to the other side of the milling disk. The setting of two adjacent teeth shall be opposite. Due to such a milling disk, fibers may be effectively plucked from the bales over the total space between the grid rods. On the other hand, the space left between the relatively low number of teeth of the milling disk is sufficient to ensure that the fiber material may be seized safely and rather deeply from the bales, thus, not affecting the individual fibers and fiber flocks over their total length. The unfavorable rasping operation is completely excluded.

According to another substantial feature of the invention, the height of the teeth may be relatively important. Preferably, the teeth height is within the range of forty percent to fifty percent of the radius of the milling disk. The tooth is offset directly at its foot portion. Thus, each individual tooth not only enters more deeply into the pressed bale, but it also covers a certain width of the removal zone. Both factors, together, ensure a careful reduction of the pressed bale, which the natural lengths of the fibers and of the flocks is maintained. Due to the relatively important height of the teeth, the individual tooth may oscillate if it hits hard material in the pressed bale. This oscillatory property of the relatively long tooth contributes to a careful fiber reduction.

Preferably, the tips of the teeth are located on an imaginary cylinder jacket spaced equally from the milling roller axis. The coverage range may be effectively extended this way.

Suitably, the contour of the teeth of the milling disk (when seen in side elevation) is nearly triangular, thus increasing the tooth resistance towards the tooth root while the oscillatory property of the teeth is retained at the same time. For processing various kinds of fibers and fiber lengths, the top rake of the teeth preferably should be within the range of minus three degrees to plus three degrees to the radial line, while the rear side of the tooth head is provided with a chamfer.

From the constructional viewpoint, it is advantageous for the milling disk to be composed of two halves which should intermesh by a dovetail type guidance. Thus, a simple interchange is possible at the milling roller. The two composed milling disk halves are kept joined safely and reliably by clamping in the milling roller.

DESCRIPTION OF THE DRAWINGS

The invention will be not explained hereunder by an embodiment shown in the drawings, in which.

DESCRIPTION OF A PREFERRED EMBODIMENT

Figure 2:
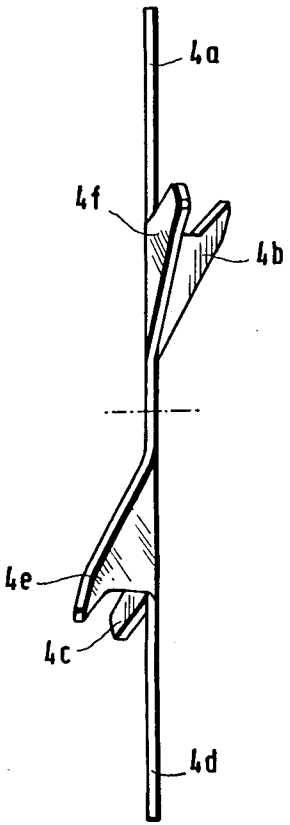
FIG. 2 is a schematic side view of the milling disk of FIG. 1.
Figure 1:
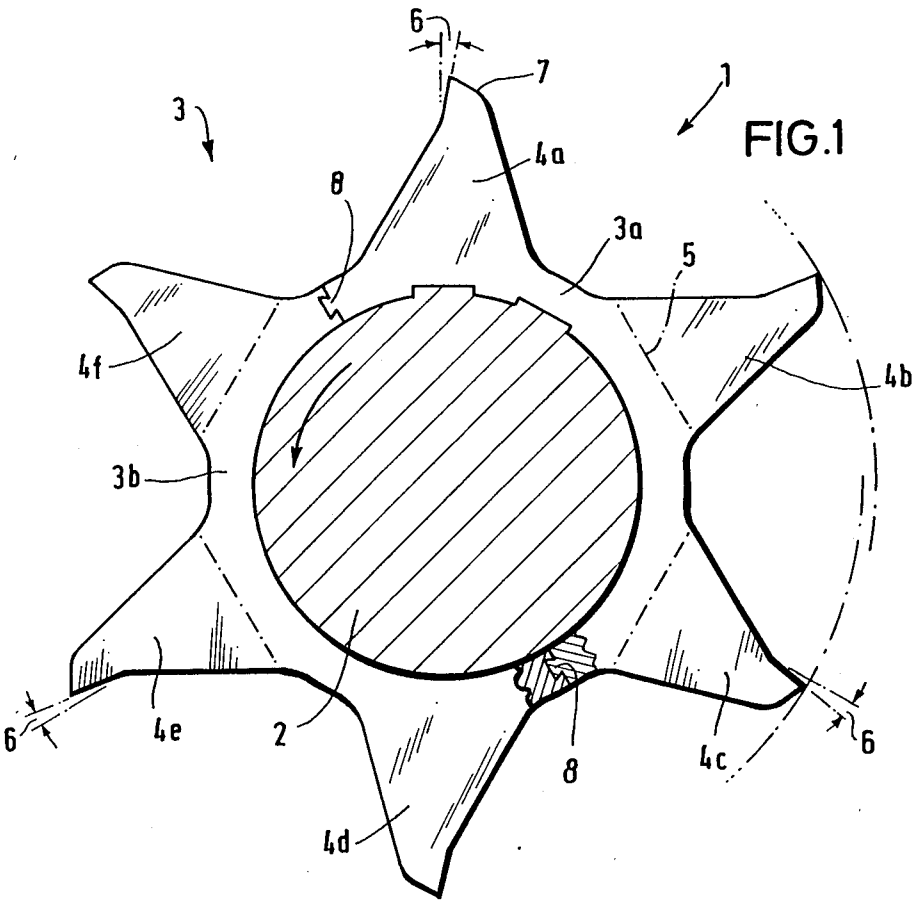
FIG. 1 is a plan view of a preferred embodiment of the milling disk according to the invention.

An opening roller 1 used for opening pressed fiber bales comprises a shaft 2 on which milling disks 3 are nonrotatingly connected at a predetermined axial distance determined by (non-illustrated) spacers of a selected length. Milling disk 3 is provided with a relatively low number of teeth 4*a*, 4*b*, 4*c*, 4*d*, 4*e*, and 4*f*, a relatively important height. Teeth 4*a* through 4*f* are offset in a predetermined manner to first one side and then the other, with respect to the disk plane. In the illustrated example, milling disk 3 has six teeth. Two teeth, 4*a* and 4*d*, are located in the disk plane while two teeth each 4*c*, 4*f* and 4*b*, 4*e* positioned diametrically extend alternatingly to one side and the other off the disk plane. Preferably, two successive or adjacent teeth should be set to extend oppositely with respect to the disk plane. For instance, (as seen from the drawings) teeth 4*b* and 4*f* are arranged to be offset upwardly, while teeth 4*c* and 4*e* are offset downwardly. Due to the height of the teeth, the setting angle may be relatively large. For instance, in case of teeth 4*b* and 4*e*, the setting angle may range between twenty degrees and thirty degrees, while the setting angle for teeth 4*c* and 4*f* is half the value thereof, i.e. ten degrees to fifteen degrees in the instant case, and the teeth located radially oppositely being bent each to another side of the disk plane. The inclinations start from the foot part of the tooth, more or less from line 5 situated tangentially relative to the corresponding diameter circle. Two teeth, 4*a*, 4*d*, are located in the plane of the milling disk 3. Preferably, the height of the teeth of milling disk 3 is within the range of forty percent to fifty percent of the radius of the milling disk. Teeth 4*b* and 4*e* having the largest angle of setting, may be somewhat longer than the other teeth. Preferably, the teeth are of such a length that their tips are situated on an imaginary cylinder jacket at an equal distance from the milling roller axis.

At the front edge of their tops, the teeth are preferably provided with a top rake 6 which is within the range of minus three degrees to plus three degrees to the radial line. Subject to the kind of material, the top rake may vary. Generally speaking, (as seen in elevation) the teeth have a relatively broad triangular contour. From the tip, the rear side of the tooth head is provided with an inclined chamfer 7. The tips of the teeth should remain sharp-edged.

To facilitate interchanging of the milling disk 3 on shaft 2, it is suitable for the milling disk to be composed of two halves 3*a* and 3*b* which are held together by dovetailed grooves 8, in that the disk halves 3*a*, 3*b* intermesh axially. Since the milling disks 3 are clamped axially on the common shaft 2, it is impossible for the disk halves to slip away in axial direction.

Figure 3:
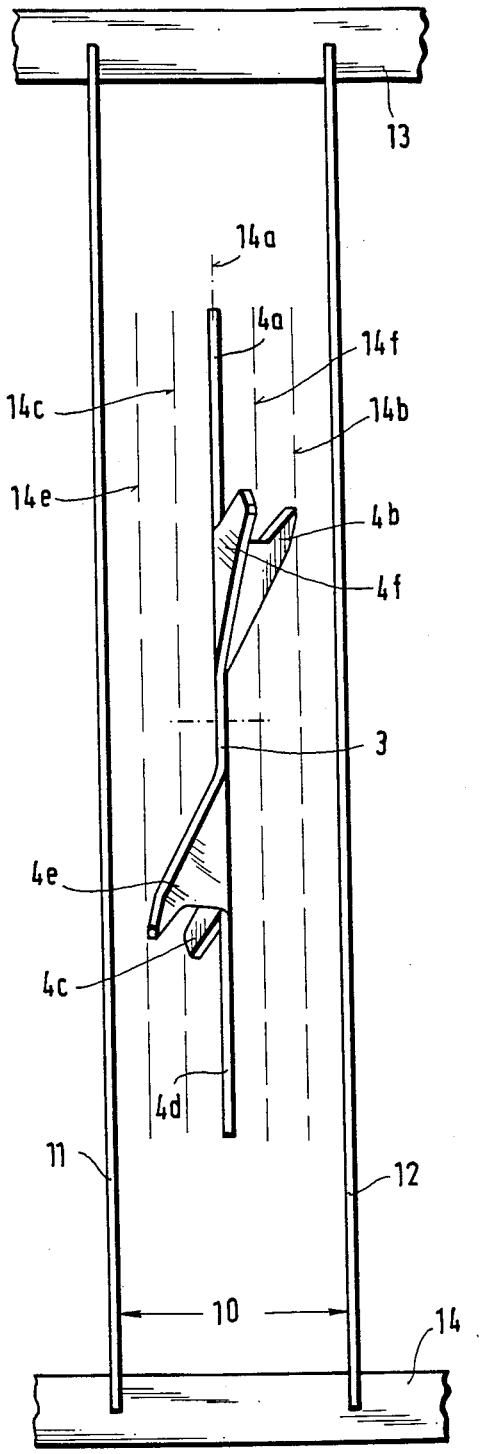
FIG. 3 shows the arrangement of the milling disk of the invention in the space between two grid rods.

The setting angle of the teeth of the milling disk 3 is suitably selected subject to a specific relationship to be maintained to the space between two of the grid rods. FIG. 3 shows two rods 11 and 12 of a grid which is guided by mountings 13 and 14 at the rod ends. Two adjacent rods 11 and 12 include a determined space 10. Due to the corresponding arrangement in the opening roller 1, the milling disk 3, with the differently set teeth 4*a* through 4*f*, is mounted in the center of the grid space 10. The projection of the differently set teeth 4 of milling disk 3 should be selected so as to ensure a uniform distribution over the space 10 confined by two grid rods 11, 12 (as seen in front view). Within the space 10 of the grid, there are five processing lines 14*a*, 14*b*, 14*c*, 14*d*, 14*e*, and 14*f*, extending at a nearly equal mutual spacing within the space 10. Thus, due to the setting of relatively long teeth, the pressed bale may be uniformly reduced over the total space 10 of the grid. The mutual setting of the teeth may be so provided that one half of the milling disk may be used for processing with respect to the non-set teeth 4*a* and 4*d*, whereupon the other side may be processed by way of teeth 4*c*, 4*d*, 4*e*. By this means, the pressed bale is reduced zonewise, with a resultant careful opening.

At the same time, the teeth enter relatively deeply into the pressed bale. The distance of the teeth 4*a*, 4*e* with the longest projection towards the adjacent grid rod 12, 11 may correspond to the uniform distribution of the processing lines 14. However, the distance may be also smaller or larger. This depends upon the kind and quality of the pressed fiber bales. The closer the approach of the set teeth with maximum projection towards the grid rods, the better the possibility of also removing, accurately, fibers from the pressed bale along the grid rods.

While a preferred embodiment of the invention has been described using specific terms, such description is for illustrative purposes only, and it is to be understood that changes and variations may be made without departing from the spirit or scope of the following claims.

What is claimed is:

1. An apparatus for opening pressed bales of spinning material such as cotton, synthetic fiber and the like, comprising:

(a) parallel first and second grid rods spaced a predetermined distance from each other;

(b) a shaft extending transversely of said grid rods and adjacent thereto; and (c) a toothed disk having a central portion with an aperture for receiving said shaft, said central portion lying in a plane transverse to the axis of said shaft, said toothed disk being supported by said shaft for rotation in a space between said grid rods, said disk having a plurality of teeth extending at an angle from the plane of said central portion so that the tips of adjacent teeth rotate in different paths within the space between said grid rods so as to act upon the top of said fiber bales in the space between said grid rods when said rods come into contact with the surface of said fiber bales.

2. An opening apparatus as set forth in claim 1, wherein said different paths are evenly distributed within the space between said grid rods.

3. An opening apparatus as set forth in claim 1, wherein the setting of the teeth on one side of said central portion plane is different from that of the teeth on the other side of said central portion plane.

4. An opening apparatus as set forth in claim 1, wherein the height of said teeth is within the range of forty percent to fifty percent of the radius of the entire disk.

5. An opening apparatus as set forth in claim 1, wherein said toothed disk is provided with six teeth, two of which revolve in the plane of said central portion, and the other four are arranged to extend alternately to opposite sides of said central portion plane.

6. An opening apparatus as set forth in claim 1, wherein the setting of adjacent teeth is opposite to each other.

7. An opening apparatus as set forth in claim 1, wherein said teeth, when said disk is viewed in plan, or of a nearly triangle contour and each of said teeth has a top rake which is between minus three degrees to plus three degrees relative to the radial line and the rear side of said tooth being inclined.

8. An opening apparatus as set forth in claim 1, wherein said toothed disk is composed of two halves which intermesh with eachother by means of a dovetail-type guide.

9. An apparatus for opening pressed bales of spinning material such as cotton, synthetic fiber and the like, comprising:

(a) parallel first and second grid rods spaced a predetermined distance from each other;

(b) a shaft extending transversely of said grid rods and adjacent thereto;

(c) mounting means for mounting said shaft for rotation above said bales; and (d) a toothed disk having a central portion lying in a plane transverse to the axis of said shaft, and supported by said shaft for rotation in the space between said grid rods, said disk having a plurality of teeth extending from said plane of said central portion and set at different angles so that the tips of adjacent teeth rotate in different paths.

10. An opening apparatus as set forth in claim 9, wherein the setting of the teeth on one side of said central portion plane is different from that of the teeth on the other side of said central portion plane.

11. An opening apparatus as set forth in claim 9, wherein the height of said teeth is within the range of forty percent to fifty percent of the radius of the entire disk.

12. An opening apparatus as set forth in claim 9, wherein said toothed disk is provided with six teeth, two of which revolve in the plane of said central portion, and the other four are arranged to extend alternately to opposite sides of said central portion plane.

13. An opening apparatus as set forth in claim 9, wherein the setting of adjacent teeth is opposite to each other.

14. An opening apparatus as set forth in claim 9, wherein said teeth, when said disk is viewed in plan, or of a nearly triangle contour and each of said teeth has a top rake which is between minus three degrees to plus three degrees relative to the radial line and the rear side of said tooth being inclined.

15. An opening apparatus as set forth in claim 9, wherein said toothed disk is composed of two halves which intermesh with each other by means of a dovetail-type guide.

* * * * *